US008588671B2

(12) United States Patent
Ng et al.

(10) Patent No.: US 8,588,671 B2
(45) Date of Patent: Nov. 19, 2013

(54) ADJUSTABLE GLOSS CONTROL METHOD WITH DIFFERENT SUBSTRATES AND 3-D IMAGE EFFECT WITH ADJUSTABLE GLOSS

(75) Inventors: Yee S. Ng, Fairport, NY (US); Hwai-Tzuu Tai, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 606 days.

(21) Appl. No.: 12/909,927

(22) Filed: Oct. 22, 2010

(65) Prior Publication Data

US 2011/0038655 A1 Feb. 17, 2011

Related U.S. Application Data

(62) Division of application No. 11/017,488, filed on Dec. 20, 2004, now Pat. No. 7,877,053.

(60) Provisional application No. 60/532,163, filed on Dec. 23, 2003.

(51) Int. Cl.
*G03G 15/20* (2006.01)

(52) U.S. Cl.
USPC ..... 399/341

(58) Field of Classification Search
USPC ..... 399/320, 341, 342; 430/45.53, 111.4, 430/124.13
See application file for complete search history.

(56) References Cited

U.S. PATENT DOCUMENTS

| | | | | |
|---|---|---|---|---|
| 5,234,783 | A | 8/1993 | Ng | |
| 5,256,507 | A | 10/1993 | Aslam et al. | |
| 5,334,471 | A | 8/1994 | Sacripante et al. | |
| 6,167,224 | A | 12/2000 | Dalal | |
| 6,535,712 | B2 | 3/2003 | Richards | |
| 6,687,483 | B2 | 2/2004 | Chen et al. | |
| 6,922,544 | B2 * | 7/2005 | Ide | 399/390 |
| 7,139,521 | B2 | 11/2006 | Ng et al. | |
| 2003/0148205 | A1 | 8/2003 | Alexandrovich | |

OTHER PUBLICATIONS

Yee Ng, et al., "Gloss Uniformity Attributes for Reflection Images," NIP17: International Conference on Digital Printing Technologies, pp. 718-722.

* cited by examiner

*Primary Examiner* — Hoan Tran
(74) *Attorney, Agent, or Firm* — Christopher J. White

(57) ABSTRACT

By using a high or low viscosity transparent toner, with respect to the other color toners, and different amounts of transparent toner lay-down, the gloss of an image printed by an electrophotographic device may be adjusted. By also applying the transparent toner as a negative mask, the differential gloss of the image may be reduced while still adjusting the gloss of certain portions of the image. Further, because different gloss levels may appear different at different viewing angles, transparent toner may be laid down to encode a transparent image within the image being printed. Such a transparent image may be useful as, for example, an authentication means for a document. Additionally, by varying the gloss levels on particular aspects of a printed image, multiple images of different gloss levels, which are prominent at different viewing angles can be made, thereby, a three-dimensional image effect can be achieved on the printed page.

5 Claims, 13 Drawing Sheets

ADJUSTABLE GLOSS CONTROL METHOD WITH DIFFERENT SUBSTRATES AND 3-D IMAGE EFFECT WITH ADJUSTABLE GLOSS

CROSS-REFERENCE TO RELATED APPLICATIONS

This is a divisional of application Ser. No. 11/017,488, filed Dec. 20, 2004, now U.S. Pat. No. 7,877,053 based on Provisional application Ser. No. 60/532,163, filed Dec. 23, 2003.

FIELD OF THE INVENTION

The present invention generally relates to controlling the adjustable gloss of an image printed on various substrates. The present invention also generally relates to creating 3-D imaging effects by controlling the adjustable gloss of a printed image.

BACKGROUND OF THE INVENTION

A fused toner image is an image formed by toner particles that are melted by heating so as to adhere to the media substrate. Gloss is related to a quantity of light reflectance that can be measured with a gloss meter. Gloss may be controlled by selecting a defined fusing temperature, with higher fusing temperatures, giving higher gloss and lower fusing temperatures giving lower gloss. The amount of gloss enhancement with the conventional fuser temperature control method, however, is limited. Moreover, adjustable gloss between various parts of the image is not possible, as the entire image must be heated uniformly by the fuser.

In high-speed, high-quality electrophotographic printing applications, it may be desirable to get higher gloss on, for example, the pictorial areas as compared to the text areas. This may be achieved by selectively applying a gloss enhancing toner on the pictorial areas, as disclosed by Ng in U.S. Pat. No. 5,234,783, herein incorporated in its entirety by reference.

However, in order to gloss-up (that is, increase the gloss of the finished printed image) the pictorial areas, a low viscosity (e.g., about 1300 poise) gloss enhancing toner must be used. There are limitations in the amount of gloss enhancing toner that may be selectively laid-down based on fuser temperature, nip width, and the like. Consequently, there are limitations in the amount of gloss enhancement that may be achieved with conventional methods. Further, by using a low viscosity gloss enhancing toner, the image relief may increase to unacceptable levels and differential gloss, for example, within the pictorial area, may also be at a level (e.g., >30) too high to be acceptable to the end user.

As can be seen, there is a need for improved adjustable gloss control between different sections of a single printed page.

SUMMARY OF THE INVENTION

As will be discussed in more detail below, and in accordance with the present invention, using higher and lower viscosity transparent toner (as compared to the viscosity of the color toners) and different amounts of transparent toner lay-down (by, for example, global exposure change, gray level continuous tone, or binary/gray level halftone) coupled with fuser temperature, roller surface and nip width adjustments, one can achieve spot gloss control with different substrates. In conjunction with using negative masks, one can also reduce differential gloss while still maintaining the adjustable gloss on the page. Furthermore, the present inventors have discovered that, because different gloss level outputs can look different at different viewing angles, one can apply extra transparent toner to encode information on the page that can be viewed only at certain angles. Such encoded information may be useful, for example, to authenticate that the printed page is an original copy.

The term "adjustable gloss" as used herein refers to the ability to selectively adjust the gloss among selected portions of the same printed page.

The term "appearance" as used herein refers to those qualities well known in the art to those in the printing field. Such qualities include, for example, gloss, color density, differential gloss, and image relief.

The term "differential gloss" as used herein refers to the differences in image gloss among different portions of the same printed page.

The term "image relief" as used herein refers to differences in image surface heights along the same printed page.

The term "low differential gloss" as used herein refers to a difference in gloss value along a printed page of less than about 30, in some instances less than about 20, and in other instances less than about 10.

The term "inline" as used herein refers to a process occurring without user intervention, usually within the same apparatus as a previous process, while the term "offline" as used herein refers to a process occurring after a break in the overall process, usually requiring the user to continue the process on a different apparatus or at a different location on the same apparatus.

In one aspect of the present invention, a method of making an image having an adjusted gloss provides laying down a four-color toner image on a media substrate; laying down a transparent toner over a portion of the media substrate, said portion being an adjusted portion for which the adjusted gloss is desired; and fusing the four-color toner and the transparent toner onto the media substrate, wherein the transparent toner is one of a gloss-up transparent toner or a gloss-down transparent toner.

In another aspect of the present invention, a method of making an image having an adjusted gloss over a pictorial region of the image provides laying down a four-color toner image on a media substrate; laying down one of a gloss-up transparent toner and/or a gloss-down transparent toner over said pictorial region; and fusing the four-color toner and the transparent toner onto the media substrate.

In yet another aspect of the present invention, a method of matching a gloss level of an image to a gloss level of a media substrate with an absence of the image thereupon, said method provides measuring the gloss level of the media substrate; laying down four-color toner onto the media substrate to form the image thereupon; laying down a first transparent toner to at least one of the image and the media substrate with the absent of the image; and fusing the four-color toner and the transparent toner onto the media substrate.

In a further aspect of the present invention, a method for controlling an adjusted gloss and a differential gloss of an image printed on a media substrate provides laying down a four-color toner image on the media substrate; calculating parameters for a gloss-based negative mask over at least a portion of the image; laying down one of a gloss-up transparent toner and/or a gloss-down transparent toner over said portion based on the gloss-based negative mask parameters; and fusing the four-color toner and the transparent toner onto the media substrate.

In still another aspect of the present invention, a method for creating a tilt image on a media substrate provides laying down one of a gloss-up transparent toner and/or a gloss-down transparent toner in a pattern of the tilt image over the media substrate; and fusing the transparent toner onto the media substrate. With the capability to produce variable gloss transparent toner on the substrate, multiple tilt images made from transparent toner of different resultant gloss can be made. Images of different gloss values can be more prominent for viewing at different viewing angles. Therefore multiple transparent toner tilt images of different gloss level can be made on the same page that can be viewed at different viewing angles. Thereby a three dimensional imaging effect can be achieved.

In yet a further aspect of the present invention, a color image printing device provides a four-station color application section for applying color toner to a media substrate to form a pre-fused image; a transparent toner application section for applying a transparent toner the pre-fused image; a fuser for fusing the pre-fused image into a fused image; and a control device for inputting the desired gloss characteristics for the color image and for adjusting the lay-down of the transparent toner to affect the desired gloss characteristics.

In yet another aspect of the present invention, a computer readable media for controlling at least one of gloss and differential gloss of at least one specific portion of a printed image on a substrate provides a code segment for obtaining a desired level of gloss and differential gloss for the at least one specific portion of the image from a user; a code segment for reading an original image from which the printed image is to be made and calculating a color toner lay-down of an original image; and a code segment for calculating an appropriate application of transparent toner based on at least one of the color toner lay-down of the original image, the desired level of gloss and differential gloss and the substrate.

These and other features, aspects and advantages of the present invention will become better understood with reference to the following description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides for controlling the adjustable gloss on a printed page by adjusting the amount and type of transparent toner laid down over the four-color image. A high viscosity transparent toner may be used as a gloss-down toner to reduce the gloss of certain portions of an image. A low viscosity transparent toner may be used as a gloss-up toner to increase the gloss of certain portions of an image. These gloss-up and gloss-down toners may be applied as a negative mask, that is, the negative of the four-color image in terms of toner height, in order to help control the differential gloss of the image. Negative mask application of either gloss-up or gloss-down transparent toner may also be useful in matching the gloss of pictorial areas with that of those areas with no pictorial areas or with text only. Unlike conventional gloss control techniques, the present invention allows for adjustable gloss within the same page while controlling differential gloss and image relief.

Conventional gloss control techniques may apply transparent toner over a page, however, it may usually be applied to the entire page, without selecting specific areas, based upon the type of image laid down thereupon, to specifically gloss-up or gloss-down. The present invention allows for creating an image having different gloss value over the page based on the type of image laid down, the user's preference, and the like.

Figure 1:
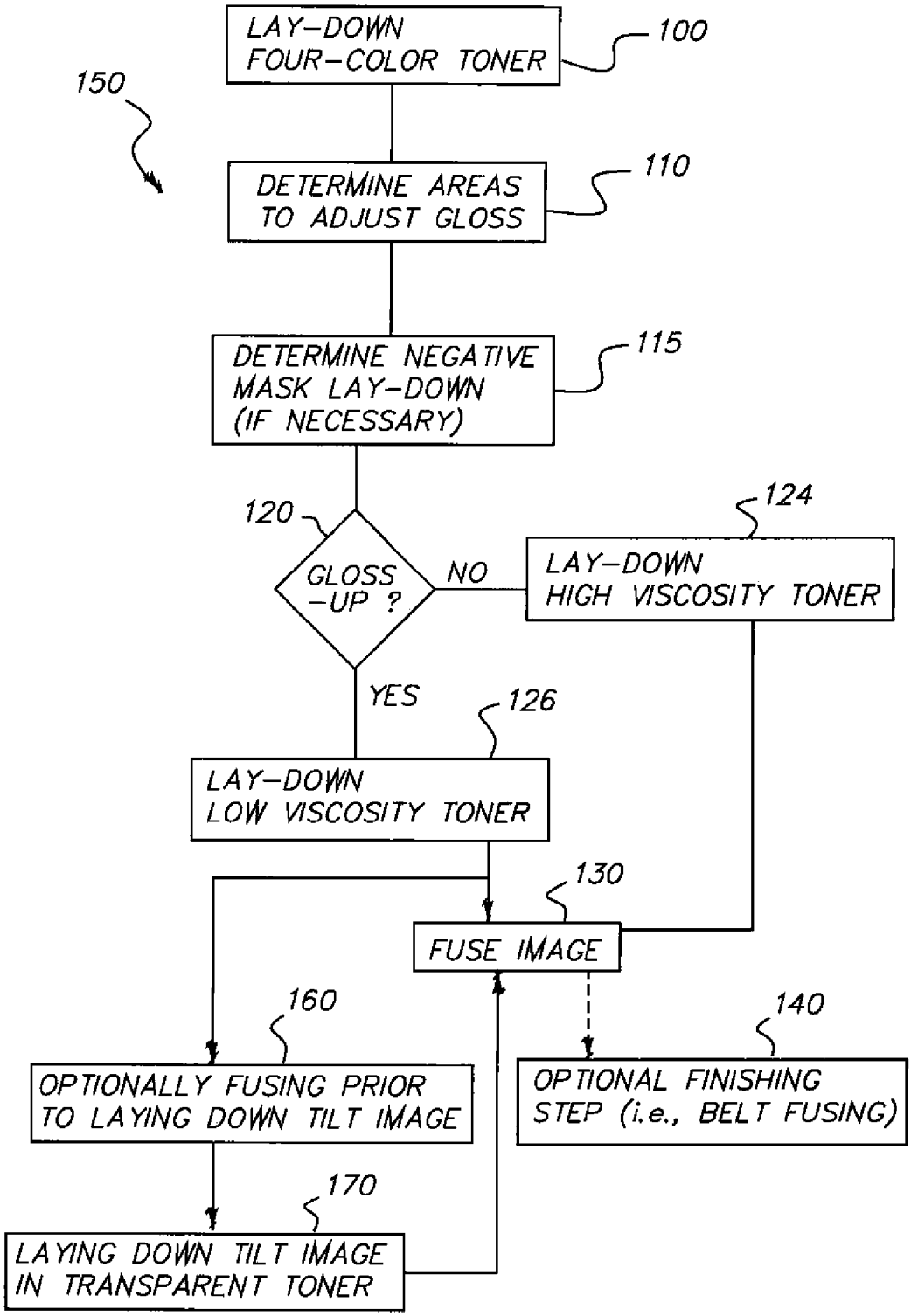
FIG. 1 is an overview flow chart showing a method for achieving adjusted image gloss according to one embodiment of the present invention.

Referring to FIG. 1, there is shown an overview of the one embodiment of the present invention, which provides a method 150 for adjusting the gloss in a portion of an image. At step 100, four-color toner may be laid down onto a media substrate, for example, a sheet or web of paper. At step 110, a determination may be made as to which areas of the image to adjust the gloss thereupon. This determination may be based on user input or the character of the image (e.g., text, bare substrate, a graphic). At step 120, a decision can be made whether to gloss-up certain portions of the page or gloss-down certain portions of the page. The determination of which areas to gloss-up or gloss-down, is discussed in more detail below. If glossing-up, the method 150 can proceed to step 126, wherein a low viscosity toner (as discussed in more detail below) may be laid down to certain areas of the image. If glossing-down, the method 150 can proceed to step 124, wherein a high viscosity toner (again, as discussed in more detail below) may be laid down to certain areas of the image. Following the gloss-up step 126 or the gloss-down step 124, the image may be fused at step 130. The final page may then be finished by, for example, conventional belt fusing at step 140. This method 150 and variations thereon will be discussed in greater detail in the paragraphs that follow.

Figure 2:
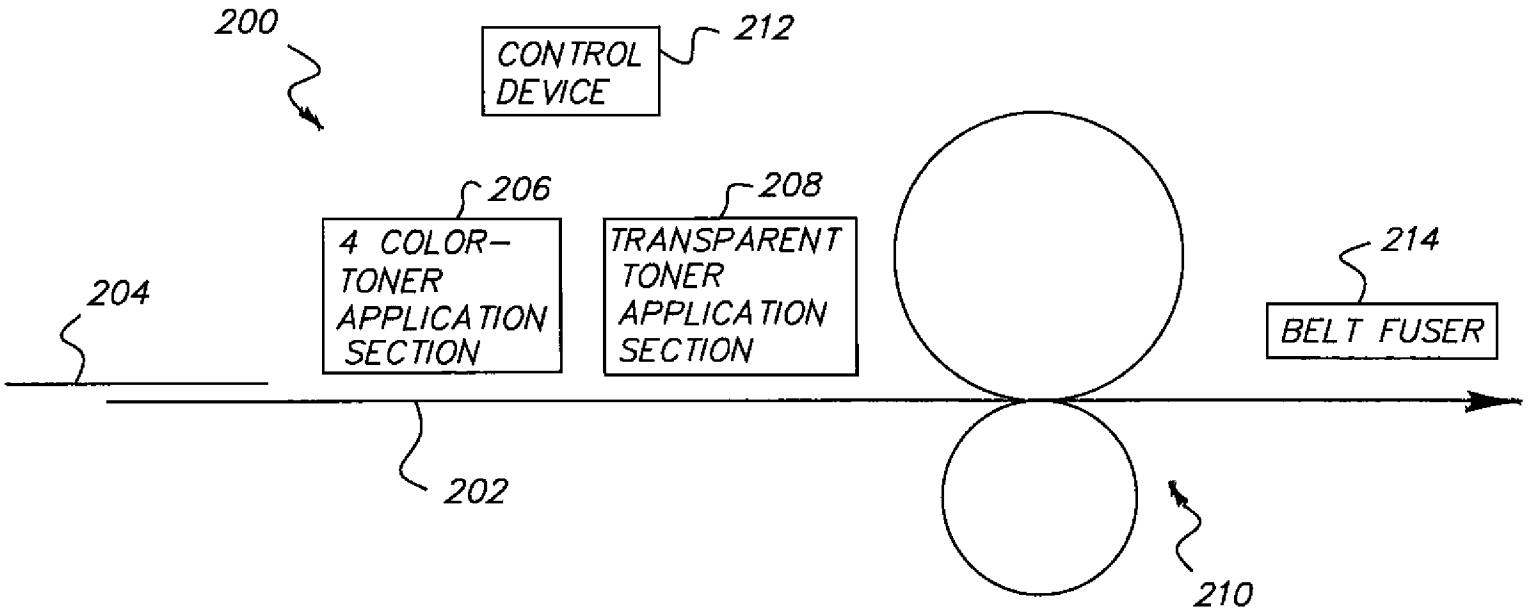
FIG. 2 is a schematic drawing showing an apparatus for performing the method according to the present invention.

Referring to FIG. 2, there is shown a schematic depiction of an apparatus 200 for carrying out an exemplary method of the present invention. The apparatus 200 may include a paper path 202 for carrying a paper 204 therethrough. A four-color toner application section 206 may apply four-color toner to the paper 204. A transparent toner application section 208 may apply transparent toner to the paper 204, following application of the four-color toner at the four-color toner application section 206. A fuser 210 may then fuse the image (both the four-color toner and the transparent toner) on the paper 204. An optional finisher, such as a conventional belt fuser 214, may finish the surface of the fused image on the paper. A control device 212 may be used for any of the following functions: inputting the image to be laid down onto the page, inputting the desired adjusted gloss/differential gloss characteristics for the page, controlling the application of four-color toner and transparent toner based on the user's desired gloss characteristics, and calculating the necessary gloss-based negative mask, if necessary, to control differential gloss.

A computer media (not shown) may contain a computer code for carrying out the above functions in control device 212. The computer media may be external to or imbedded within control device 212.

Figure 3:
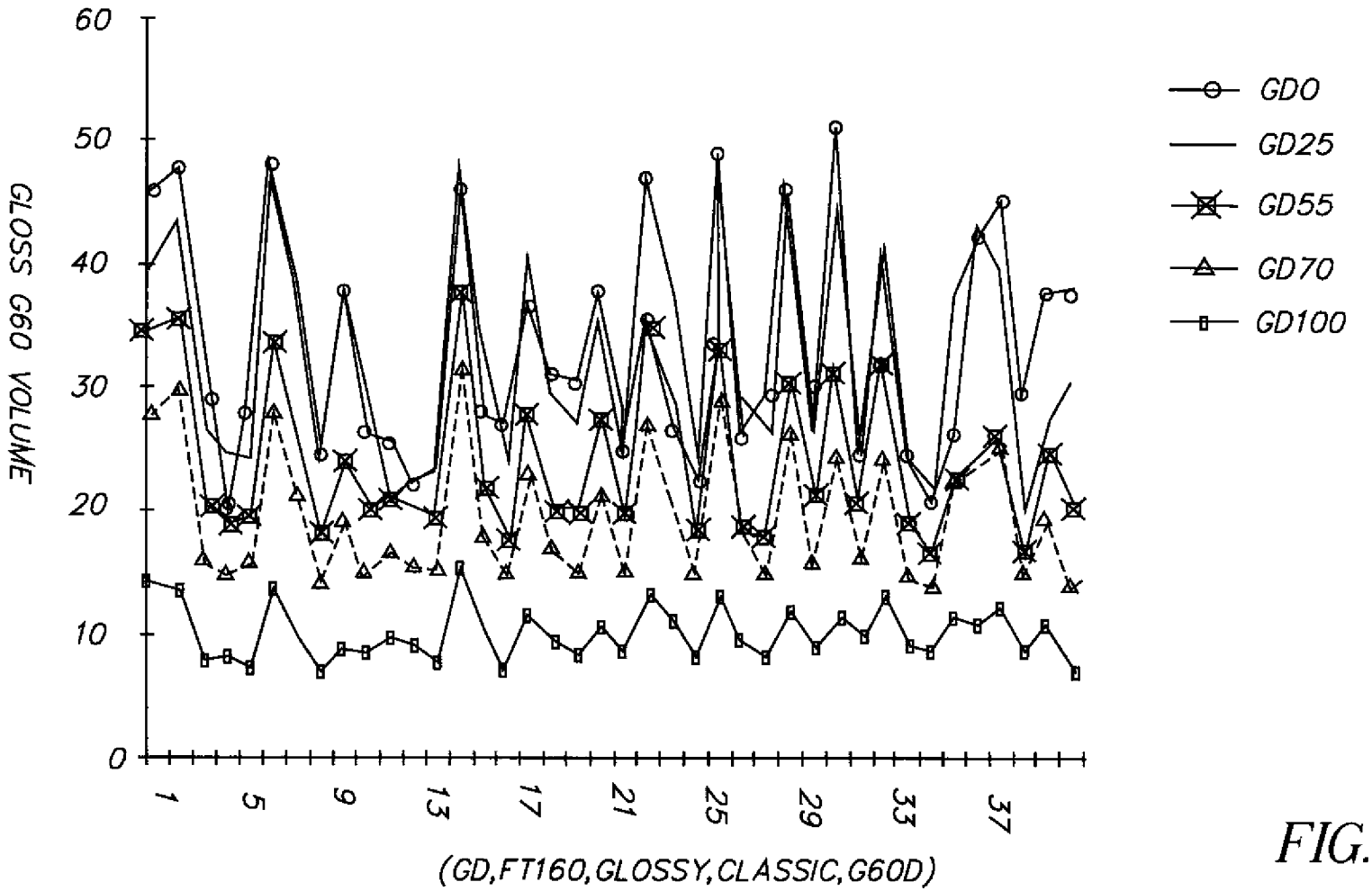
FIG. 3 is a graph showing how the gloss level of various color patches change with varying amounts of gloss-down transparent toner according to the present invention.

Referring to FIG. 3, there is shown a graph depicting how the gloss levels of various (numbered) color patches change with varying amounts of gloss-down transparent toner according to the present invention. The color paths are derived from the differential gloss test Gloss Uniformity for Printing Systems (INCITS W1.1), ISET's PICS 2003 Proceedings (pp. 88-93). The data from these curves may be useful in the calculations chart used in Yee S. Ng "Standardization of Perceptual Based Gloss and made in control device 212 when the user selects gloss-down and/or control of differential gloss for a particular area of the image. Using a higher viscosity toner (as compared to the viscosity of the four-color toner set, e.g., about 10,000-80,000 poise) on the same fuser, the adjustable gloss-down of the desired spot image area may be affected by laying down a different amount of transparent toner (see step 124 of FIG. 1). The percentages used in this graph (as well as those which follow) for lay down (0 to 100%) refer to toner coverage (continuous-tone, as well as halftone). This graph demonstrates a gloss-down from a maximum gloss, G60, of about 50 to a G60 value of about 19. FIG. 3 shows that uniformity gloss at different colorant coverage can be achieved with the addition of different amount of gloss-down transparent toners and also get a mean adjustable gloss in the range of 15 to 20 at the same time.

One application of the present invention, using the data from FIG. 3, from a spot gloss viewpoint, may be to gloss-down and match the overall substrate gloss. In step 120 of FIG. 1, a decision can be made whether to gloss-up certain portions of the page or gloss-down certain portions of the page. When the user chooses to gloss-down a portion of the image (step 124), while trying to match substrate gloss, different amounts of transparent toner can be used on different spot gloss areas to accomplish matching the image gloss to the substrate gloss in some areas, but give an appearance of higher gloss in other spot gloss areas. It is known in the art that the gloss level of a fused image varies with the type of substrate, such as paper 204, and the amount of color toner lay-down. For example, with a matte-finish substrate (having a surface gloss of about 5-10), as the amount of color toner lay-down increases, the amount of gloss increases. With an intermediate gloss level finish substrate (having a surface of about 30-40), as the color toner lay-down increases, the gloss begins to increase, dips to a lower gloss level, and then increases further as the color toner lay-down increases toward about 300% (see for example, Yee Ng et al., "Gloss Uniformity Attributes for Reflection Images", IS&T's NIP 17 Proceedings, pp. 718-722, 2001. With a glossy substrate (having a surface gloss of about 60-70), as the color toner lay-down increases, the gloss level decreases. Therefore, by knowing the substrate type and the amount of color toner lay-down (based upon the original image), one can determine the amount and location of gloss-down transparent toner needed to match the image gloss to the substrate gloss.

Once the gloss of the entire image (bare substrate and fused image) is matched, one may then also create an appearance of higher gloss in some areas by the application of a second gloss-up or a gloss-down toner by passing the paper 204 through the apparatus 200 a second time, which may apply the second gloss-up or gloss-down toner via transparent toner application section 208.

Referring now to FIGS. 4 through 8, there are shown graphs of gloss (GD60) versus color toner lay-down [from 0 to 300% color (i.e., 100% of all three colors) toner lay-down] using an intermediate gloss level (gloss level of about 38) paper for various amounts of gloss-down toner. Generally, each curve shows, as discussed above, that, as the color toner lay-down increases, the gloss begins to increase, dips to a lower gloss level, and then increases further as the color toner lay-down increases toward about 300%. Each curve also slows the effect of gloss-down toner lay-down on the substrate alone, that is, with zero percent color toner lay-down. This data shows the gloss level of the substrate alone (with no color toner lay-down, but with only fused gloss-down toner) changing from about 38 (no gloss-down toner) to about 7 (100% gloss-down toner).

Figure 4:
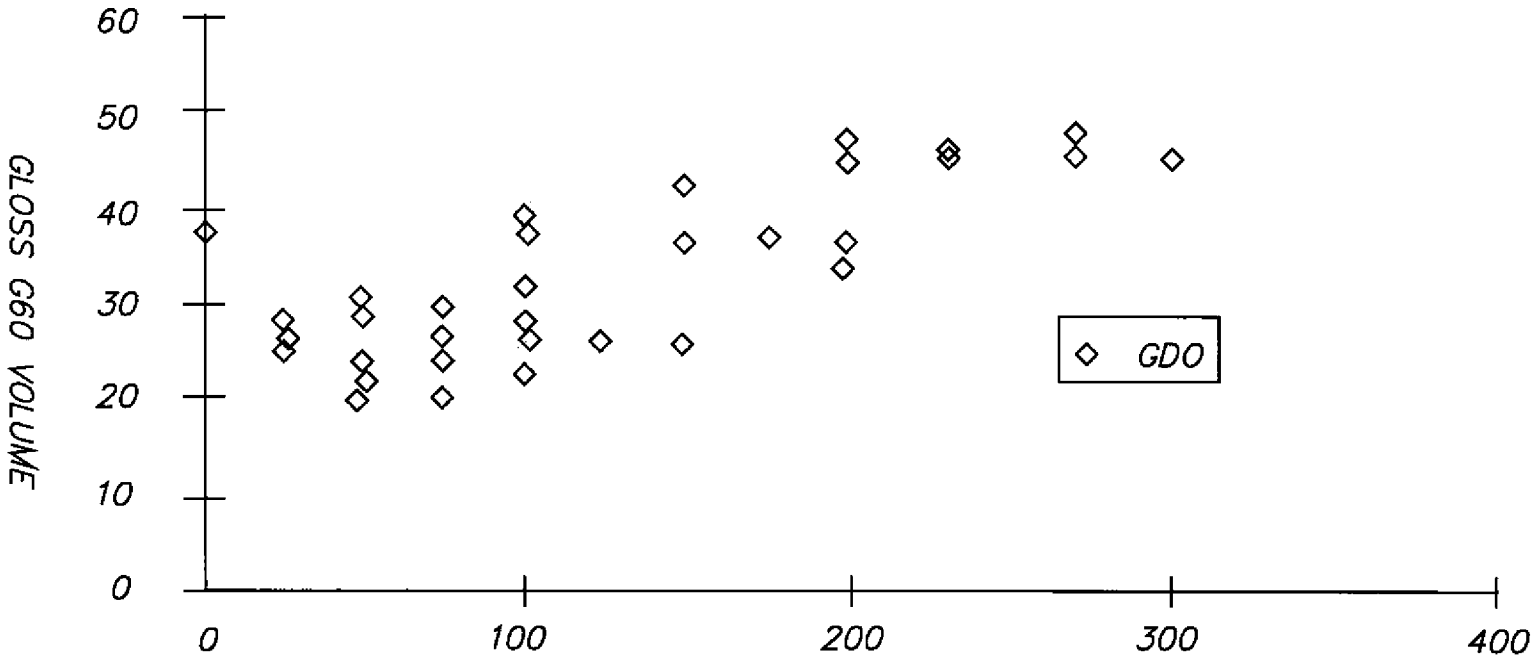
FIG. 4 shows the relationship between the amount of color toner lay-down and gloss with no gloss-down transparent toner.

Referring specifically to FIG. 4, with no gloss-down toner application, the gloss is variable based on color toner lay-down, giving gloss values from about 20 to about 50.

Figure 5:
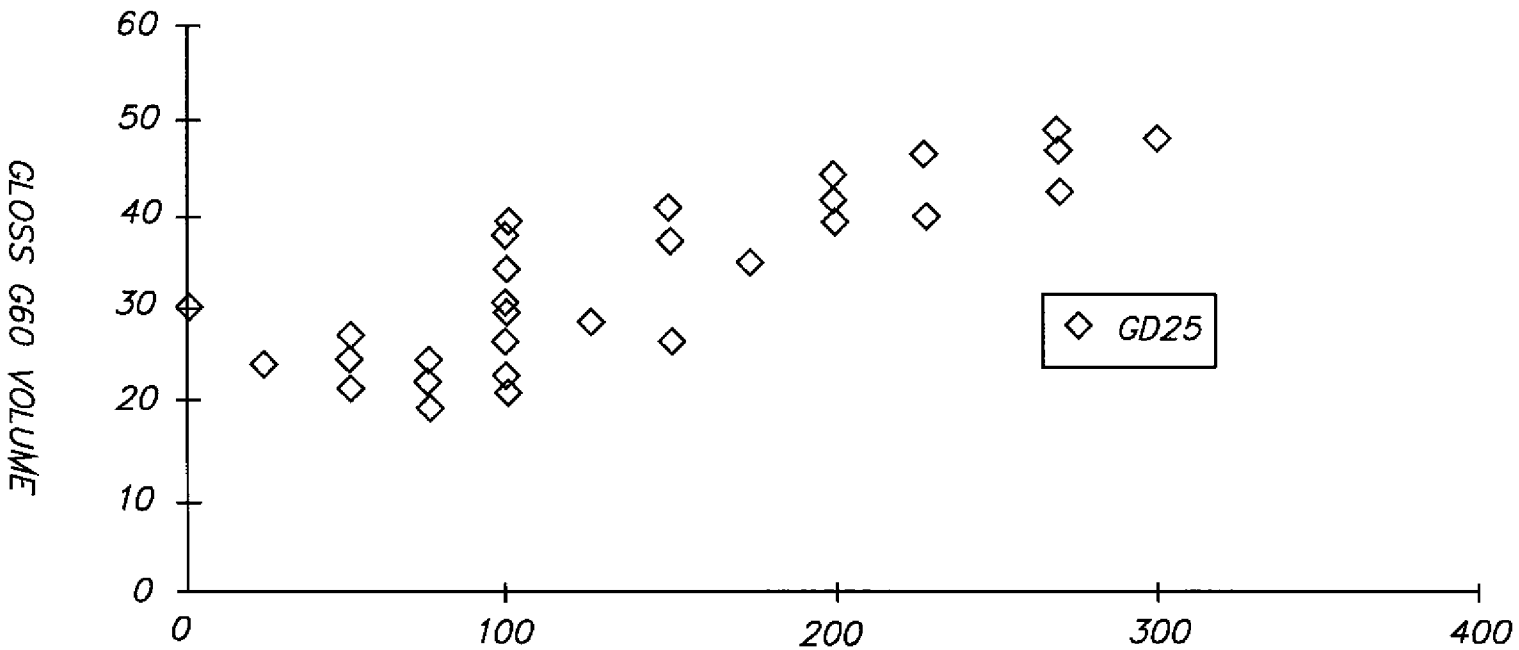
FIG. 5 shows the relationship between the amount of color toner lay-down and gloss with 25% gloss-down transparent toner.

Referring specifically to FIG. 5, with 25% gloss-down toner lay-down, there is some tightening of the curve (that is, less out lying data points from a theoretical best fit line), however no significant control of differential gloss. The gloss value with 25% gloss-down toner lay-down still varies from about 20 to about 50.

Figure 6:
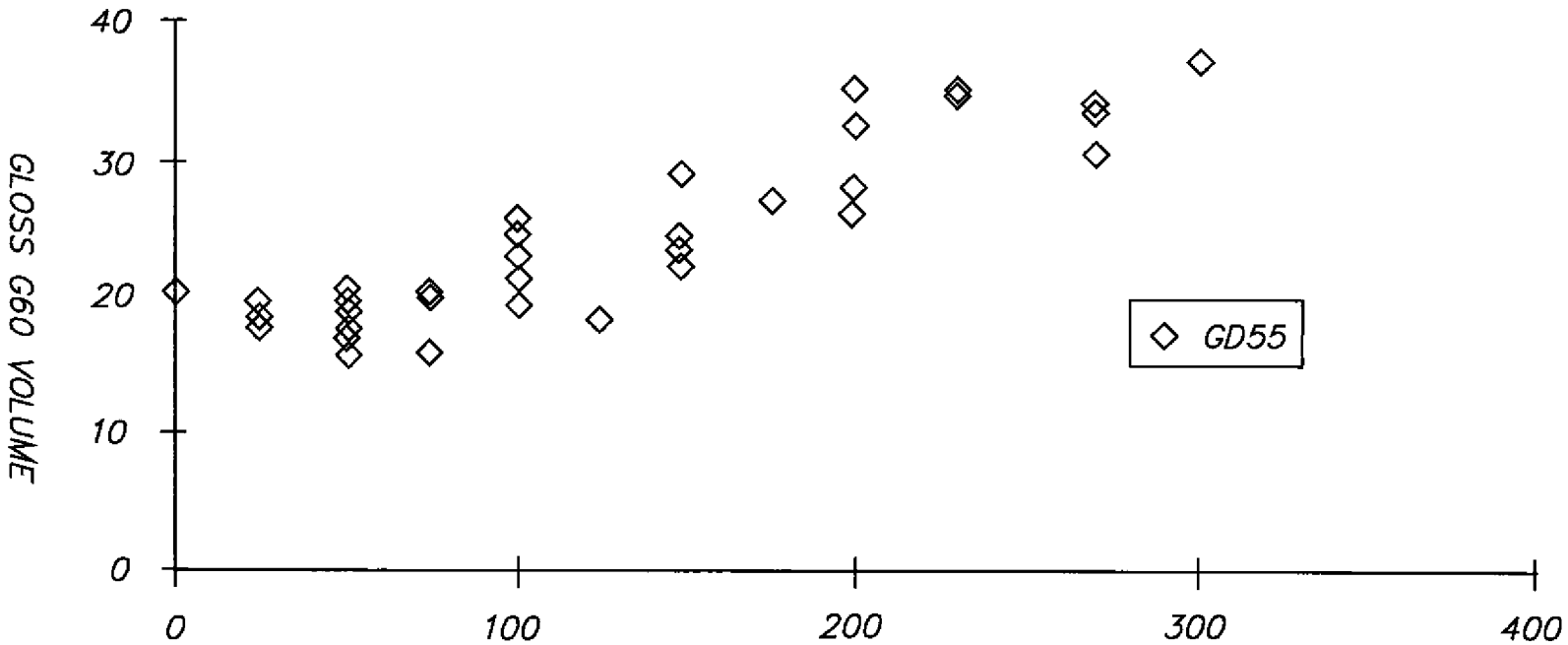
FIG. 6 shows the relationship between the amount of color toner lay-down and gloss with 55% gloss-down transparent toner.

Referring specifically to FIG. 6, with 55% gloss-down toner lay-down, some differential gloss control is noted, with the gloss values ranging from about 15 to about 48.

Figure 7:
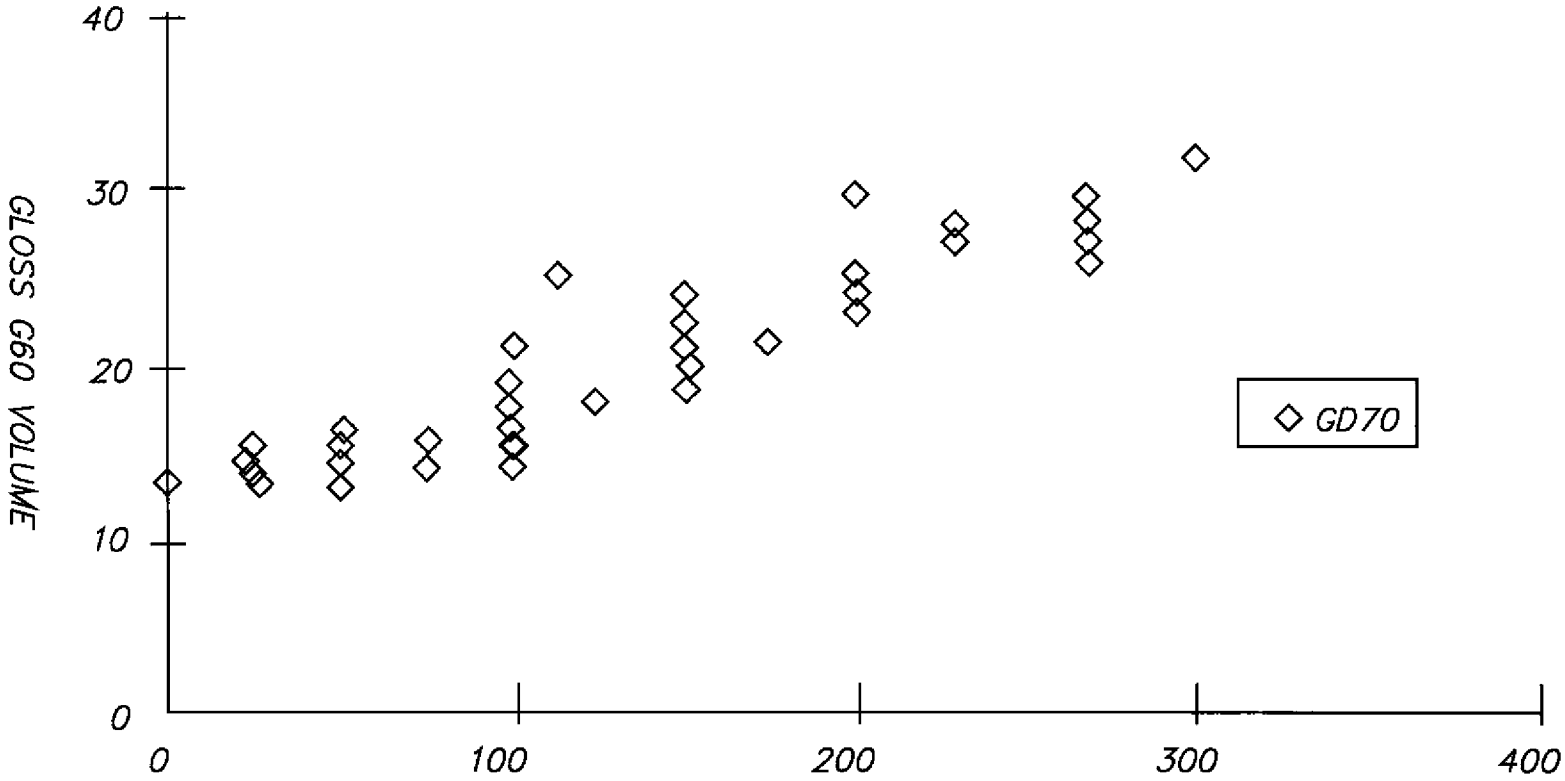
FIG. 7 shows the relationship between the amount of color toner lay-down and gloss with 70% gloss-down transparent toner.

Referring now to FIG. 7, with 70% gloss-down toner lay-down, substantial tightening of the curve is noted, showing a clearer, almost linear function of color toner lay-down versus image gloss. The gloss values, with 70% gloss-down toner lay-down range from about 14 to about 32, confirming even further control of differential gloss.

Figure 8:
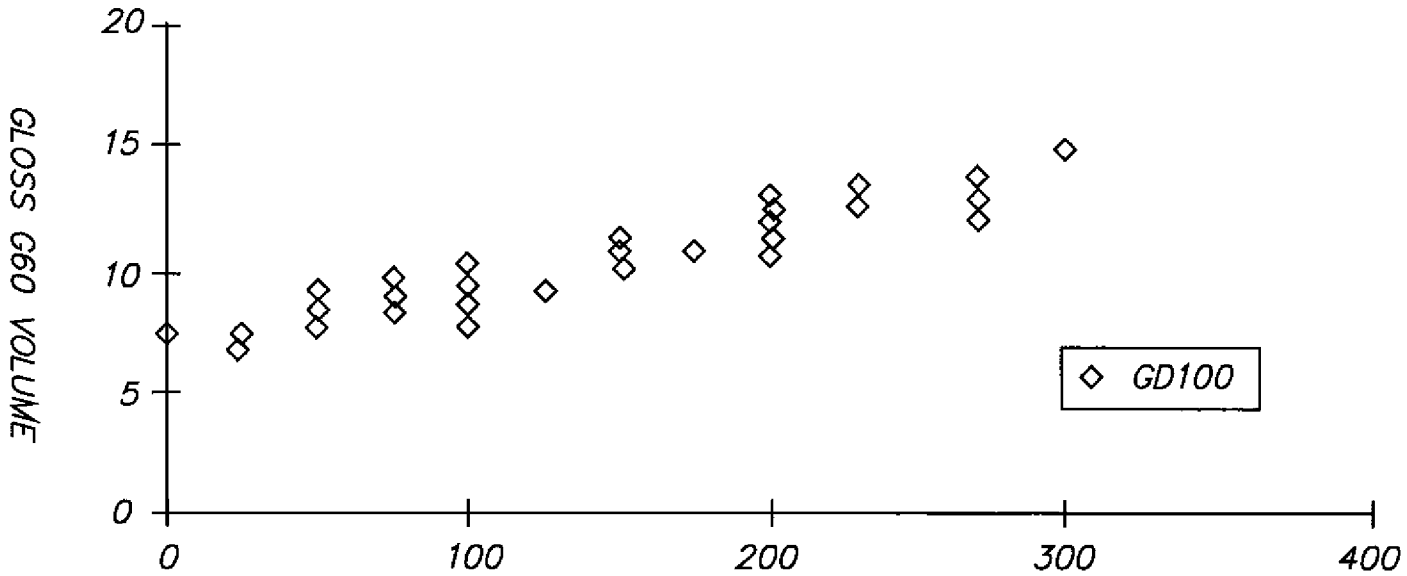
FIG. 8 shows the relationship between the amount of color toner lay-down and gloss with 100% gloss-down transparent toner.

Referring to FIG. 8, with 100% gloss-down toner lay-down, substantial differential gloss control is achieved, with the gloss level varying from about 7 to about 15 with varying color toner lay-down. Moreover, adjustable gloss may be achieved by spot application of, for example, 100% gloss-down toner. As FIGS. 4 through 8 show, substrate alone may have a gloss value that varies from about 38 to about 7 with varying amounts of gloss-down toner lay-down. Thus, adjustable gloss and reduction in differential gloss may be achieved at the same time by variable application of the amount of gloss-down toner lay-down as shown in FIG. 3 between a gloss range of 15 to 20.

EXAMPLE

Referring to FIGS. 9 through 13, there are shown two examples of a gloss-down transparent toner that may be used to reduce differential gloss on a printed page while still allowing for adjusted gloss within the page.

Figure 9:
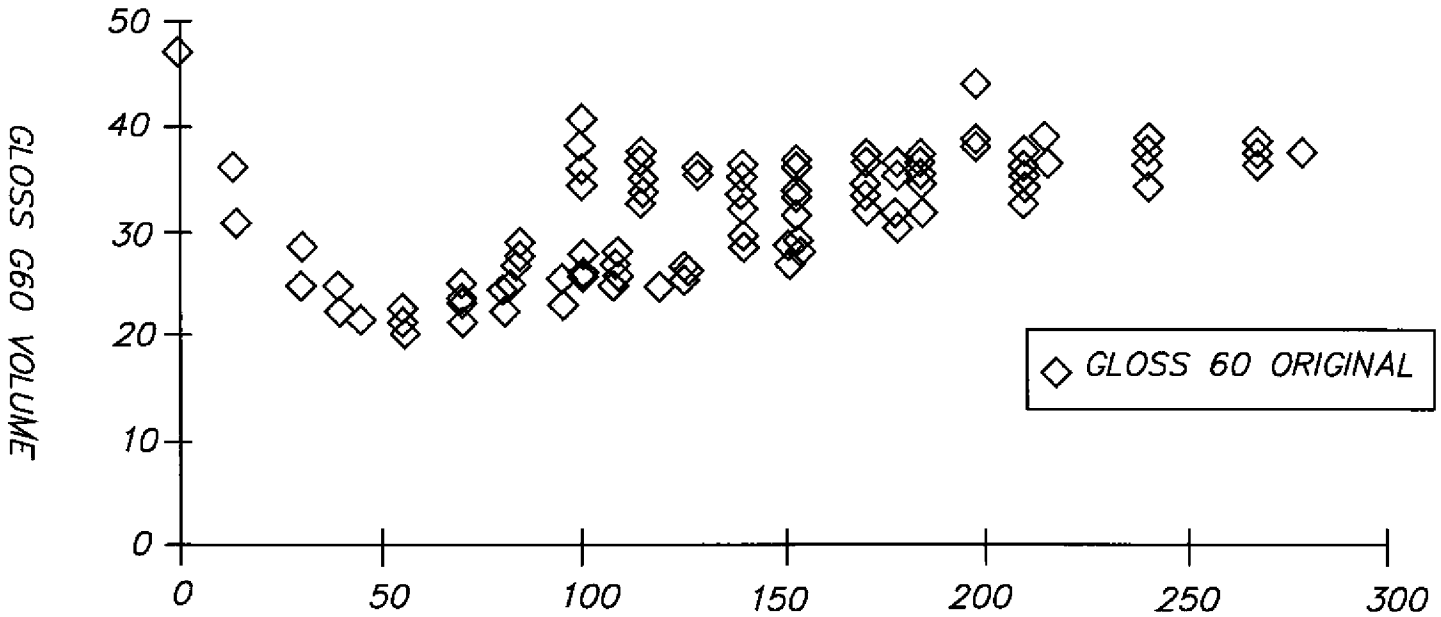
FIG. 9 shows the relationship between gloss level of an untreated image prior to treatment by the present invention and color toner lay-down.
Figure 10:
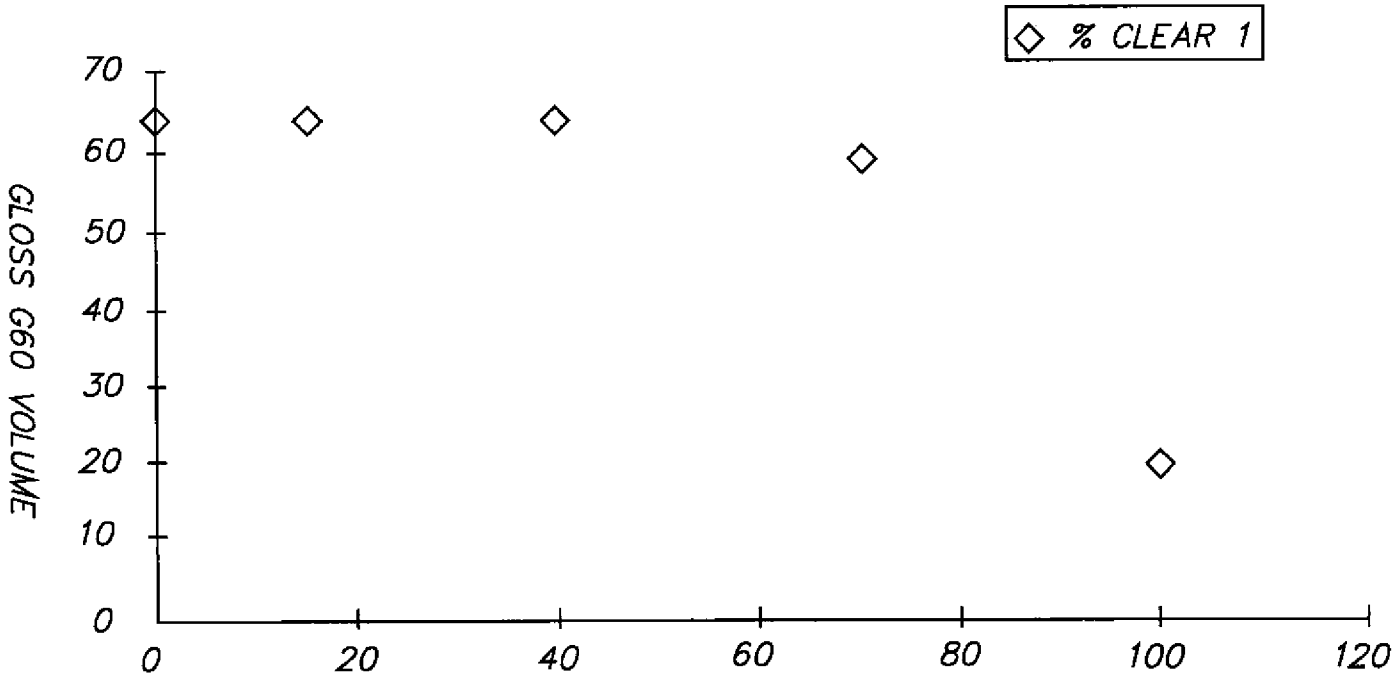
FIG. 10 shows gloss level as a function of the amount of one type of clear toner lay-down according to the present invention.
Figure 11:
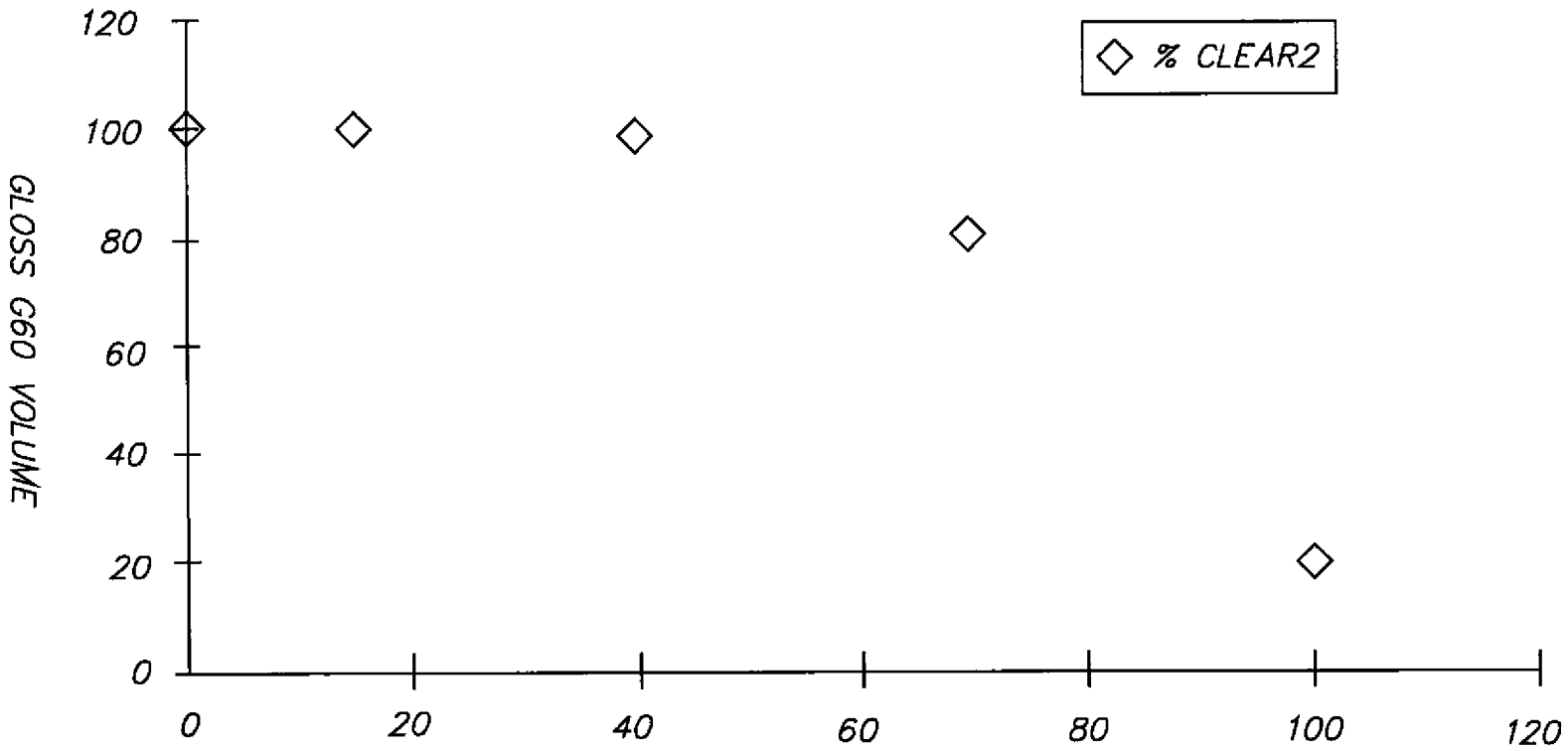
FIG. 11 shows gloss level as a function of the amount of another type of clear toner lay-down according to the present invention.
Figure 12:
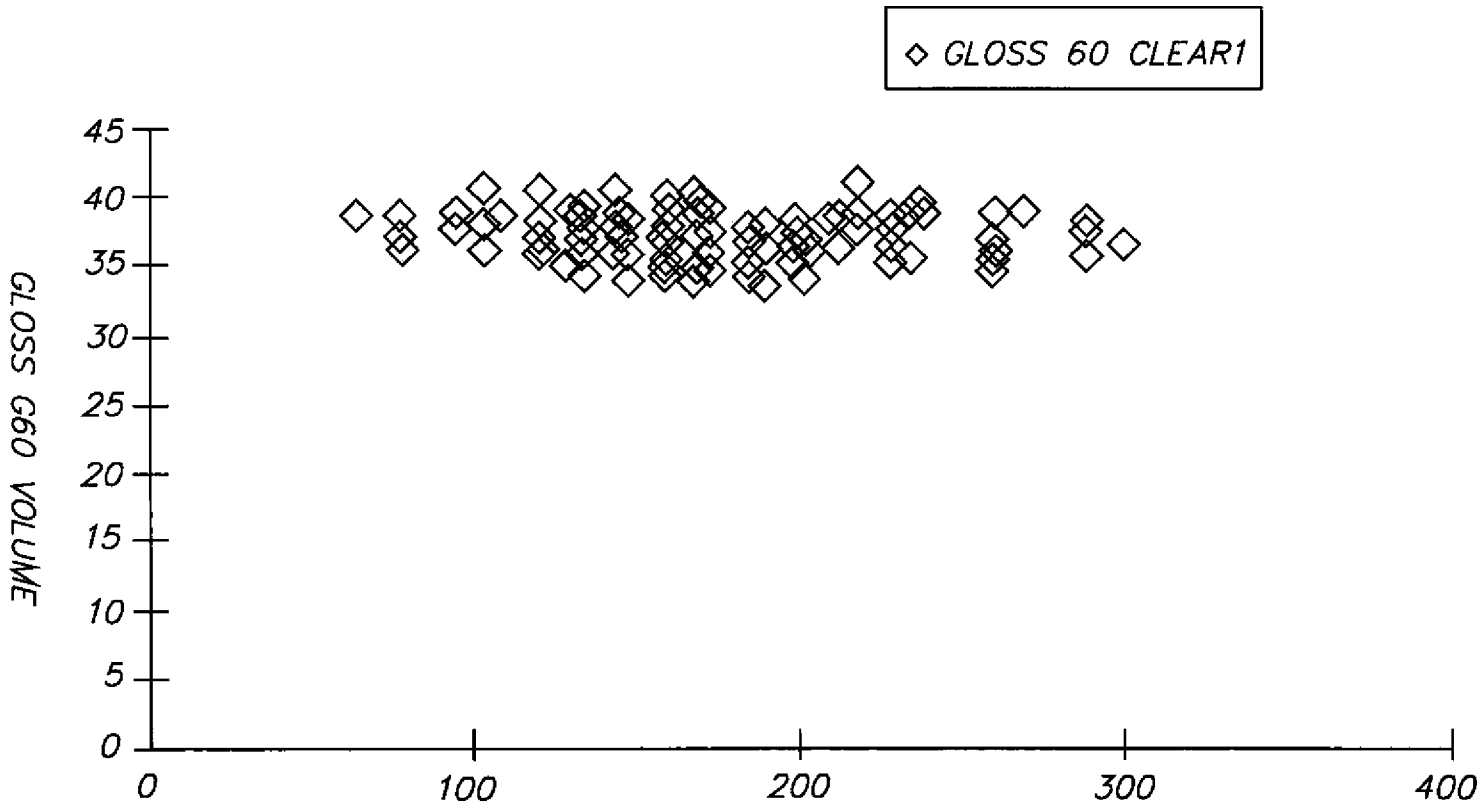
FIG. 12 shows the relationship between gloss and color toner lay-down when treated by the clear toner of FIG. 10 according to the present invention.
Figure 13:
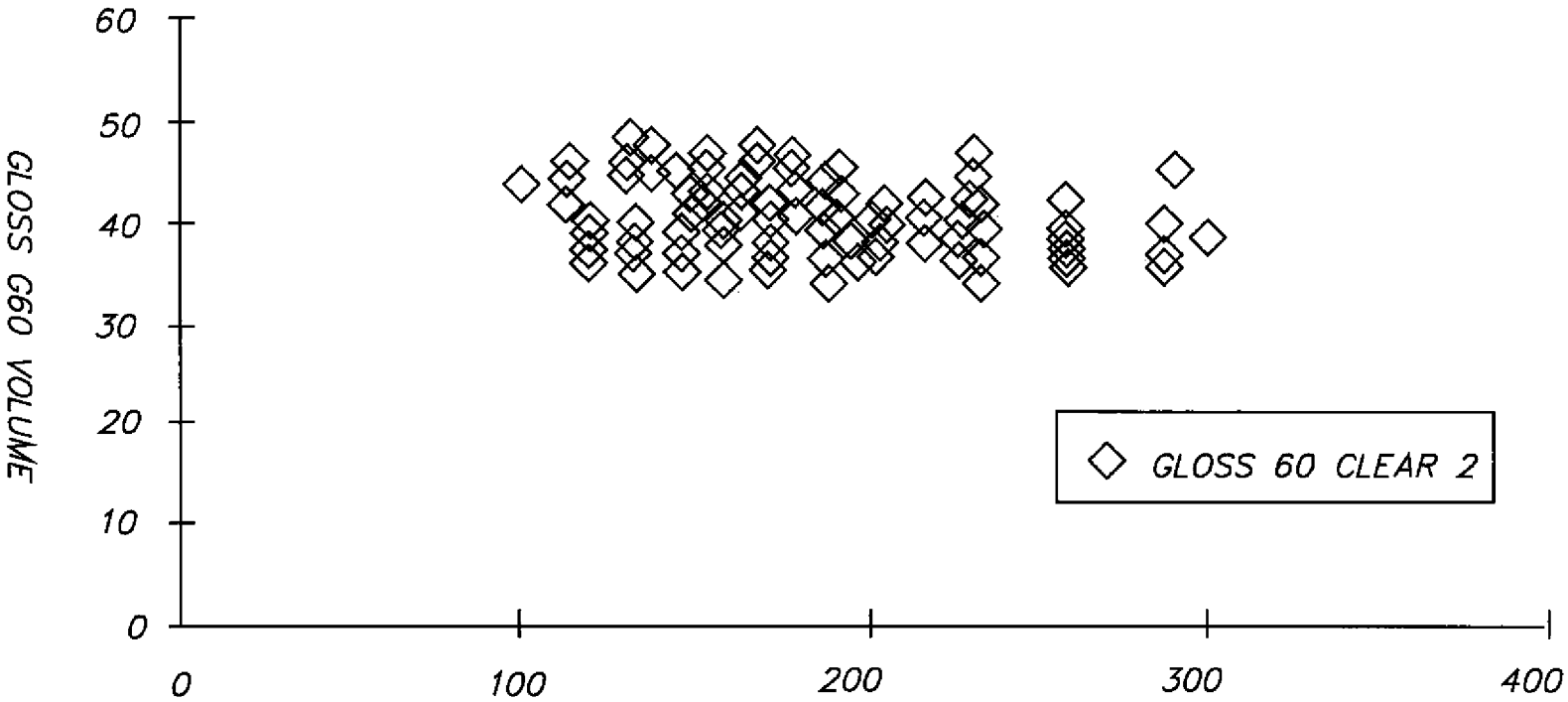
FIG. 13 shows the relationship between gloss and color toner lay-down when treated by the clear toner of FIG. 11 according to the present invention.

More specifically, FIG. 9 shows gloss level of an "untreated" image as a function of the total amount of toner lay-down. By describing the image as "untreated," it is meant that the image has not been adjusted by any embodiment of the present invention. FIGS. 10 and 11 show the amount of gloss-down that may be achieved by adjusting the lay-down amounts of transparent toners 1 and 2 (Clear1 and Clear 2), respectively using the color separation that has the maximum coverage at that pixel location as reference. FIG. 12 shows the reduction in differential gloss by using Clear1 transparent toner as a function of varying amounts of toner lay-down. By comparing FIG. 12 to FIG. 9, it can be seen that the differential gloss may be reduced from about 25 (untreated image) to about 9 (image treated with Clear1 transparent gloss-down toner) with an average gloss of 37. FIG. 13 shows the reduction in differential gloss by using Clear2 transparent toner as a function of varying amounts of toner lay-down. By comparing FIG. 13 to FIG. 9, it can be seen that the differential gloss may be reduced from about 25 (untreated image) to about 15 (image treated with Clear2 transparent gloss-down toner) with an average gloss of 41.

These two examples show the effect of transparent gloss-down toners Clear1 and Clear2 on the differential gloss of an image regardless of the color toner lay-down. In addition to this reduction in differential gloss, if desired, the image may be imparted with an adjusted gloss by varying the amount of transparent toner lay-down on various portions of the image.

While the above discussion has focused on gloss-down transparent toner, the present invention is not limited to that particular embodiment. By using a lower viscosity transparent toner (in comparison with the four-color toner set), for example, a transparent toner having a viscosity from about 1000 to about 2000 poise, and the same fusing conditions, one can affect the adjustable gloss-up on the desired spot image area (step 126 of FIG. 1). Coupled with a gloss-based negative mask (discussed in more detail in the following paragraph), one can achieve adjustable gloss patches and reduction of differential gloss at those adjustable gloss level patches at the same time. Of course, the range of the gloss adjustment may be further enhanced with various fuser roller surface finishes, fusing temperatures and nip width selections.

The above-described process may be done inline, within a single printing device by, for example, applying the transparent toner [gloss-up (step 126) or gloss-down (step 124)] to the pre-fused image 204 followed by fusing to supply the finished product. Alternatively, the process may be done offline, requiring the user to feed the prints through another apparatus to fuse the desired transparent toner lay-down thereto. In a hybrid embodiment of the present invention, the four-color image may first be fused to the substrate followed by the appropriate transparent toner lay-down being fused, in a separate step, albeit still inline, to the already fused color image.

One application of the above observation shown in FIGS. 4 through 8 is to apply gloss-down toner as a negative mask. In other words, the amount of transparent toner laid down (step 124) may vary inversely with the amount of the four-color toner lay-down (step 100), as shown in optional step 115 for determining the negative mask transparent toner lay-down. However, rather than basing the negative mask lay-down on four-color toner height, the negative mask lay-down may be based on the gloss value anticipated based on the color toner lay-down (as may be determined by the graphs of FIGS. 4 through 8, or, any similar set of calibration curves generated on a particular substrate for a particular amount of gloss-down and color toner lay-down. By using this gloss-variable negative mask technique, the gloss value may be selectively adjustable between different locations on the image (for example, between text and pictorial areas). Moreover, by using this technique, the differential gloss within a particular area (for example, within a text area) may be controlled to a low differential gloss (e.g., less than about 20).

As mentioned above, adjustable gloss levels may be used to create a "tilt image" or, in other words, an image that may be viewed at a particular angle due to its different gloss level. Referring back to FIG. 1, by first adjusting the gloss as desired by laying-down the appropriate transparent toner, as shown in step 124 or 126, to create an adjusted gloss image, and then creating an "image" with transparent toner (step 170) which will impart a different gloss level when fused, a tilt image may be formed. The adjusted gloss image may be fused (step 160) prior to the application of the tilt image transparent toner (step 170). Alternatively, the entire image, including the tilt image transparent toner, may be fused in a single step (step 130) to form the finished product. The finished product may be finished by, for example, conventional roller fusing at step 140. The tilt image may have a gloss level greater than or less than the gloss level of the surrounding text and graphics. Therefore, when viewed at a particular angle, the different gloss level will impart the visual sensation of an image within the gloss. These tilt images may be useful, for example, as authentication images to verify that certain documents are originals, as the tilt image may not appear in a conventional copy. Moreover, these tilt images may be used to create a three-dimensional effect by varying the amount of gloss by degrees around a particular image.

It should be understood, of course, that the foregoing relates to exemplary embodiments of the invention and that modifications may be made without departing from the spirit and scope of the invention as set forth in the following claims.

PARTS LIST

100 step of applying four-color toner
110 step of determining which areas to adjust gloss
115 step of determining the negative mask lay-down
120 step of determining to gloss-up or gloss-down
122 step of glossing-up
124 step of glossing-down
130 step of fusing
140 step of finishing (belt fusing)
150 the method of FIG. 1
160 step of fusing prior to laying down the tilt image
170 step of laying down the tilt image
200 apparatus
202 paper path
204 paper
206 four-color toner application section
208 transparent toner application section
210 fuser
212 control device
214 belt fuser

What is claimed is:

1. A color image printing device comprising:

a four-station color application section for applying color toner to a media substrate to form a pre-fused image;

a transparent toner application section for applying a transparent toner to the pre-fused image;

a fuser for fusing the pre-fused image into a fused image; and a control device for inputting a desired gloss characteristics for the color image and for adjusting lay-down of the transparent toner to affect the desired gloss characteristics.

2. The printing device according to claim 1, further comprising a belt fuser for finishing the fused image into a final product.

3. The printing device according to claim 1, wherein said fuser is a heated roller fuser.

4. The printing device according to claim 1, wherein the control device includes a computer readable media containing computer code for controlling at least one of gloss and differential gloss of at least one specific portion of a printed image on a substrate.

5. The printing device according to claim 1, wherein the control device adjusts the lay-down of the transparent toner to match the image gloss to the substrate gloss in an area of the image.

* * * * *